US007803096B2

(12) United States Patent
Mehta

(10) Patent No.: US 7,803,096 B2
(45) Date of Patent: Sep. 28, 2010

(54) ROCKING EXERCISER SYSTEM

(75) Inventor: Pershant Mehta, Houston, TX (US)

(73) Assignee: Je Matadi, Inc., Stafford, TX (US)

( * ) Notice: Subject to any disclaimer, the term of this patent is extended or adjusted under 35 U.S.C. 154(b) by 0 days.

(21) Appl. No.: 12/636,602

(22) Filed: Dec. 11, 2009

(65) Prior Publication Data

US 2010/0152005 A1 Jun. 17, 2010

Related U.S. Application Data

(60) Provisional application No. 61/201,455, filed on Dec. 11, 2008.

(51) Int. Cl.

| | |
|---|---|
| ***A63B 22/16*** | (2006.01) |
| ***A63B 22/14*** | (2006.01) |
| ***A63B 21/018*** | (2006.01) |
| ***A63B 21/008*** | (2006.01) |
| ***A63B 21/02*** | (2006.01) |

(52) U.S. Cl. ..... 482/140; 482/92; 482/112; 482/119; 482/123; 482/142

(58) Field of Classification Search ..... 482/95, 482/96, 111, 112, 114, 115, 118, 119, 121, 482/130–132, 146–148, 907

See application file for complete search history.

(56) References Cited

U.S. PATENT DOCUMENTS

| | | | | |
|---|---|---|---|---|
| 150,436 | A | 5/1874 | Scheuerle et al. | |
| 735,319 | A | 8/1903 | Urwick | |
| 2,707,465 | A | 5/1955 | Nemeth | |
| 3,659,844 | A | 5/1972 | Cummins | |
| 5,570,929 | A | 11/1996 | Glockl | |
| 5,590,930 | A | 1/1997 | Glockl | |
| 5,628,632 | A | 5/1997 | Doane | |
| 5,755,651 | A | 5/1998 | Homyonfer et al. | |
| 5,795,271 | A * | 8/1998 | Pearson | 482/72 |
| 5,860,899 | A | 1/1999 | Rassman | |
| 5,941,807 | A | 8/1999 | Cassidy et al. | |
| 6,468,191 | B1 | 10/2002 | Cameron | |
| 7,090,628 | B2 | 8/2006 | Badarneh | |
| 7,288,055 | B2 | 10/2007 | Blaum | |
| 7,338,125 | B2 | 3/2008 | Grabowski | |
| 7,350,865 | B2 | 4/2008 | Pearse | |
| 7,438,675 | B2 | 10/2008 | Lin | |
| D582,996 | S | 12/2008 | Mehta | |

(Continued)

*Primary Examiner*—Loan Thanh
*Assistant Examiner*—Victor K Hwang
(74) *Attorney, Agent, or Firm*—Haynes and Boone, LLP

(57) ABSTRACT

An exercise machine which has a base with at least three spaced apart legs and two spaced apart handles attached to the base. A rocker assembly that includes a rocker fastener and first and second sets of spaced apart brackets is provided where the second set of brackets rotates relative to the first set of brackets along a longitudinal axis of rotation. The longitudinal axis of rotation passes between the handles and is substantially parallel to the handles and the second set of brackets rotates only about the longitudinal axis of rotation. The first set of brackets is secured to the base and the second set of brackets is secured to the underside of a rotation assembly. The rotation assembly is coupled to a seat to enable rotation of the seat relative to the second set of brackets. The rotation assembly includes a stop to limit rotation of the seat.

8 Claims, 6 Drawing Sheets

U.S. PATENT DOCUMENTS

| | | | | |
|---|---|---|---|---|
| 7,476,188 | B2 | 1/2009 | Perez, Jr. | |
| 7,621,860 | B2 | 11/2009 | Burrell | |
| 7,625,323 | B1 * | 12/2009 | Lin | 482/112 |
| 7,704,200 | B2 | 4/2010 | Rahimi | |
| 7,713,182 | B2 | 5/2010 | Bizzell et al. | |
| 2005/0101460 | A1 | 5/2005 | Lobban | |
| 2005/0130816 | A1 * | 6/2005 | Huang | 482/140 |
| 2006/0116261 | A1 * | 6/2006 | Hsiung et al. | 482/140 |
| 2007/0298943 | A1 * | 12/2007 | Mehta | 482/115 |
| 2007/0298945 | A1 | 12/2007 | Mehta | |
| 2009/0058156 | A1 | 3/2009 | Gang | |

* cited by examiner

ROCKING EXERCISER SYSTEM

CROSS-REFERENCE TO RELATED APPLICATIONS

The present application claims priority from U.S. Provisional Patent Application No. 61/201,455, entitled "Rocking Exerciser System", filed on Dec. 11, 2008, the disclosure of which is incorporated herein by reference in its entirety.

BACKGROUND

The present invention generally relates to an exercise machine and more particularly, to an exercise machine adapted for a variety of exercises for improving the muscle tone, particularly in the abdominal region, and cardiovascular fitness of the user. Methods of using the exercise machine are also provided.

SUMMARY

The present invention generally relates to an exercise machine and more particularly, to an exercise machine adapted for a variety of exercises for improving the muscle tone, particularly in the abdominal region, and cardiovascular fitness of the user. Methods of using the exercise machine are also provided.

One example of an exercise machine of the present invention comprises a base frame, a rocker bracket secured to the base frame about a fixed longitudinal axis of rotation so that the rocker bracket rotates about the axis of rotation in a side-to-side motion relative to the base frame, and a seat rotatably attached to the rocker bracket so that the seat rotates relative to the rocker bracket. For example, an elongated bolt or shaft may be used to movably secure the rocker bracket to the base.

In one preferred embodiment, side to side rocking of the seat is limited to an 18 degree incline from the horizontal around a fixed longitudinal axis. Likewise, in one preferred embodiment, rotation of the seat is limited to approximately +/−10 degrees or less (total range is 20 degrees) about a fixed longitudinal axis. One or more stops may be utilized to limit seat rotation. In one embodiment, these stops are adjustable in order to adjust seat rotation from 360 degrees to some lesser amount, as desired. Notably, this partial rotation, when combined with the side to side motion of the rocker bracket, allows one to create the hip movement associated with certain Latin dance styles. Further, it has been found that in some cases, to maximize the benefits of the side-to-side motion discussed above, i.e., to focus the core muscles on this movement, it is desirable to limit the rotational movement as described herein. Thus, one novel feature in certain embodiments of the invention is the partial rotation of the seat when combined with the side to side rocking motion of the seat.

In one preferred embodiment, tension may be placed between the moving components of the device to provide further resistance. A tensioning mechanism for the rocker bracket may include one or more springs and/or pistons. A tensioning mechanism for the rotating seat may include a brake or other tensioning mechanism, such as a belt around the perimeter of a drum secured to the seat. In related embodiments the tensioning mechanism may be adjustable to alter the resistance. For example, a piston may include a piston cylinder with an adjustable volume, while a spring may have an adjustable tension in a manner well known in the art.

The machine further includes support legs attached to the base. In one embodiment, the support legs are removable so as to enhance transportability of the system. Such removable legs may also be desirable for shipping large quantities of the machine in bulk since the machines are more compact with the legs removed.

BRIEF DESCRIPTION OF THE DRAWINGS

A more complete understanding of the present disclosure and advantages thereof may be acquired by referring to the following description taken in conjunction with the accompanying figures, wherein.

Figure 1:
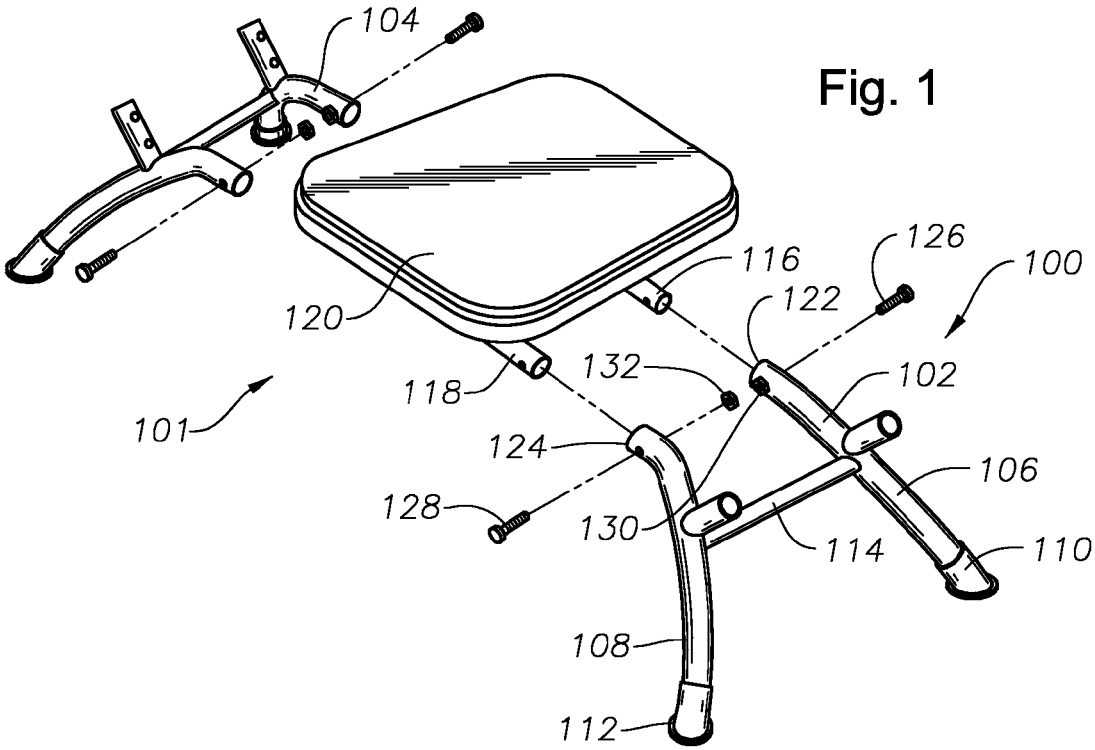
FIG. 1 illustrates a partially exploded view of one embodiment of an exercise machine.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

The present invention generally relates to an exercise station and more particularly, to an exercise station adapted for a variety of exercises for improving the muscle tone, particularly in the abdominal region, and cardiovascular fitness of the user. Methods of using the exercise station are also provided.

In certain embodiments, exercise stations of the present invention comprise, among other features, a base frame, a rocker bracket secured to the base frame about a fixed longitudinal axis of rotation so that the rocker bracket rotates about the axis of rotation in a side-to-side motion relative to the base frame, and a seat rotatably attached to the rocker bracket so that the seat rotates relative to the rocker bracket. Additional optional features of the exercise station of the present invention include support handles for gripping the exercise station and one or more legs for support of the base.

To facilitate a better understanding of the present invention, the following examples of certain embodiments are given. In no way should the following examples be read to limit, or define, the scope of the invention.

FIG. 1 illustrates an exploded perspective view of one embodiment of a lower portion 100 of an exercise station 101. Lower portion 100 is generally disposed to rest on the floor or other surfaces during use and provide stability to the movable portions of exercise station 101. Lower portion 100 includes subframes 102 and 104 and base 120. In this embodiment, subframe 104 is substantially identical to subframe 102, therefore only subframe 102 will be discussed below. Subframe 102 is comprised of a plurality of support legs 106 and 108. Support legs 106 and 108 may each include feet 110 and 112 to provide a friction surface area to prevent slippage of subframe 102 during use of exercise station 101. Feet 110 and 112 may be rubber or plastic or any material known in the art suitable for preventing slippage of the device. In an exemplary embodiment, feet 110 and 112 may be height adjustable to allow for variations in the floor or in the subframes 102 and 104. In the illustrated embodiment, support legs 106 and 108 may be connected by cross-member 114 to provide additional support to subframe 102. Support legs 106 and 108 may be connected to connection members 116 and 118 of base 120 by inserting the connection members into ends 122 and 124. Fasteners 126 and 128 may then be inserted through aligned holes in connection members 116 and 118 and ends 122 and 124 as shown in FIG. 1. In one preferred embodiment, fasteners 126 and 128 may be bolts which are threaded into nuts 130 and 132 that are attached to ends 122 and 124, however fasteners used to attach or connect the various members of exercise station 101 may be any suitable connection mechanism known in the art, including, but not limited to, screw connections, glue, compression bonding, thermal bonding, nails, clip connections, interference fits, quick release connections, welded connections, or any combination thereof. Subframe 104 is formed and attached to base 120 by similar means. In an exemplary embodiment, the attachment of subframes 102 and 104 to the base 120 may result in an exercise station that is 16 inches above the floor. In use, as described below, it has been found that 16 inches is an optimal height for use of exercise station 101.

Figure 2:
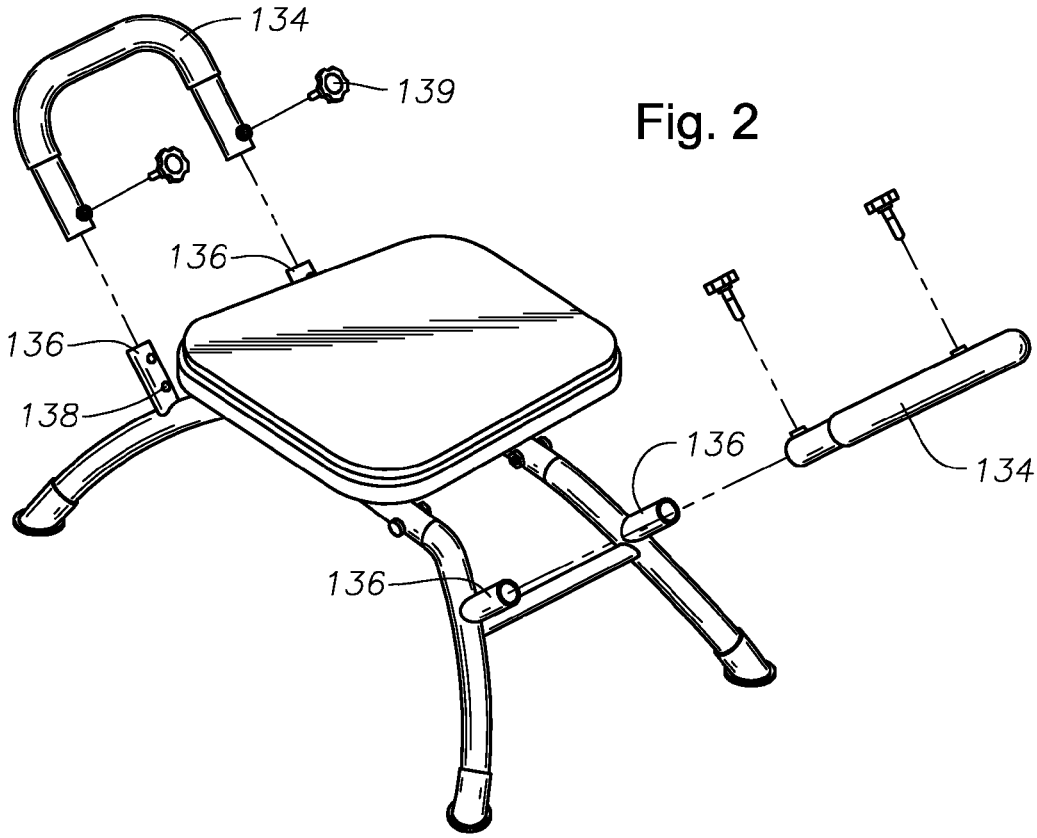
FIG. 2 illustrates a partially exploded view of one embodiment of an exercise machine.

FIG. 2 illustrates an exploded perspective view of one embodiment of exercise station 101 showing the attachment of handles 134 into subframes 102 and 104 of lower portion 100. Subframes 102 and 104 include handle stubs 136. Handle stubs 136 may include a plurality of mounting holes 138. Handles 134 may be attached to subframes 102 and 104 as shown in FIG. 2 using fasteners 139. In the illustrated embodiment, fasteners 139 are threaded and have large knobs adapted to be operated by hand so as to allow easy assembly and adjustment of the exercise station 101 without the need for tools. In an alternative embodiment, fasteners 139 could comprise a quick release mechanism, or other type of connection mechanism as known in the art.

Figure 3:
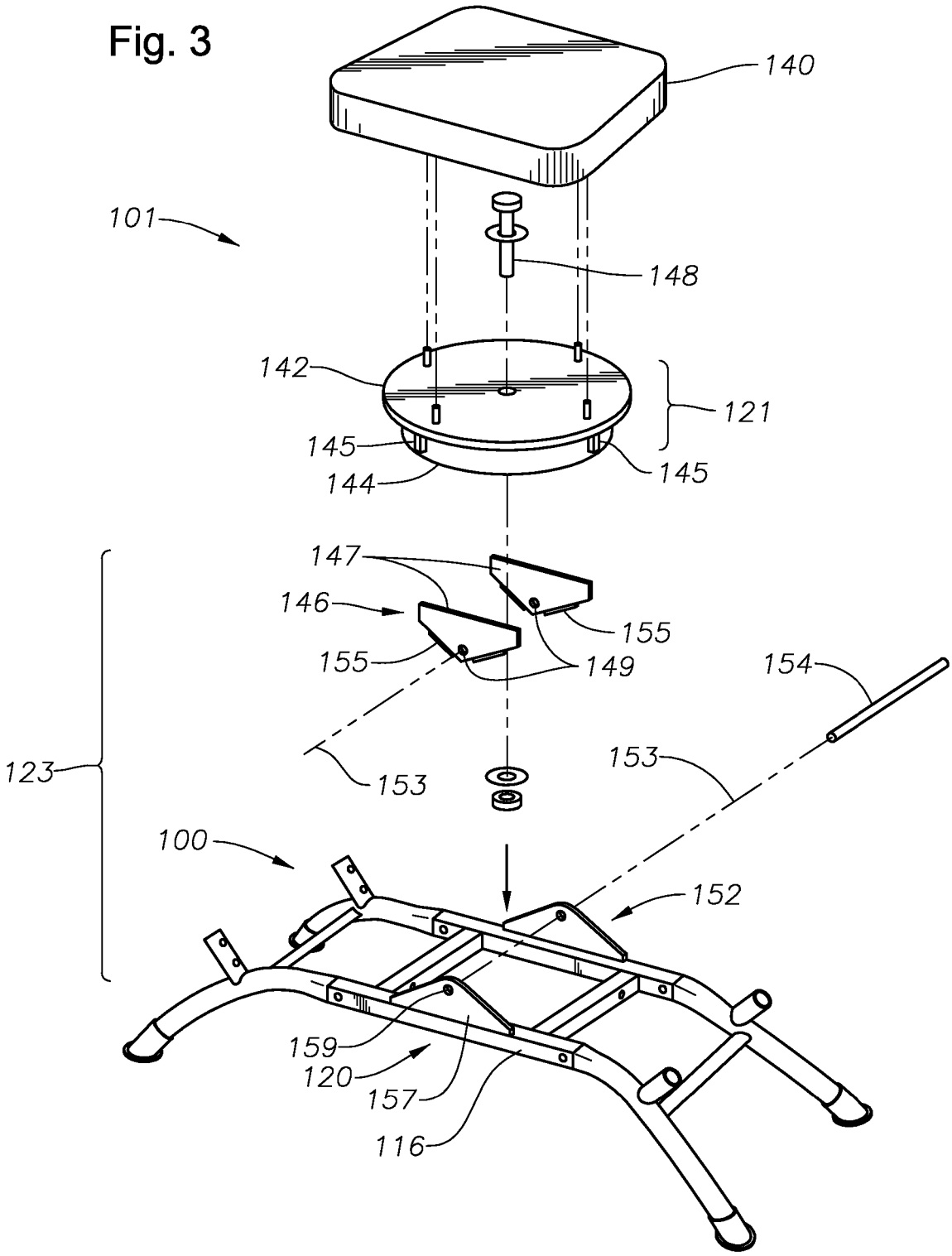
FIG. 3 illustrates various components of the exercise machine, along with movements thereof.

FIG. 3 illustrates an exploded side view of one embodiment of exercise station 101 where a seat 140 is shown for attachment to a rotation assembly 121 which is in turn secured to a rocker assembly 123. Seat 140 may be cushioned for the comfort of the user. In certain embodiments, seat 140 may be contoured to more comfortably engage the user. For example, the upper surface of seat 140 may be contoured to better stabilize the user on the seat when the seat is in motion. In certain other embodiments, seat 140 may have a plurality of apertures to assist in the heat dissipation of the user and/or to reduce the weight of seat 140. In certain other embodiments, the top and bottom of the seat 140 are generally planar.

In an exemplary embodiment, rotation assembly 121 includes upper rotator 142 rotatably connected to lower plate 144 through the rotation bolt 148. Seat 140 is connected to upper rotator 142. In one embodiment, the upper rotator 142 may rotate +/−90 degrees relative to the lower plate 144 (total range is 180 degrees). In one embodiment, rotation of the seat is limited to approximately +/−10 degrees or less (total range is 20 degrees). One or more stops 145 may be utilized to limit seat rotation as are known to one of ordinary skill in the art. In one embodiment, these stops 145 are adjustable in order to adjust seat rotation from 360 degrees to some lesser amount, as desired.

The lower plate 144 of the rotation assembly 121 attaches to the upper rocker assembly 146 of the rocker assembly 123. The rocker assembly 123 includes the upper rocker assembly 146 that comprises two spaced apart brackets 147 with an aligned hole 149 through the two spaced apart brackets 147. The lower rocker assembly 152 includes two spaced apart brackets 157 with an aligned hole 159 through the brackets 157. The rocker assembly 123 is formed by the upper rocker assembly 146 and lower rocker assembly 152 disposed so that the holes 149 and 159 are aligned. One or more rocker bolts 154 can be passed through the holes 149 and 159 to provide an axle for relative pivotal movement of the upper and lower rocker assemblies 146 and 152 around a fixed longitudinal axis 153 formed by the rocker bolt 154. Notably, the fixed longitudinal axis 153 extends in a fixed direction so as to always be between and parallel to the vertical plane formed by the two handles 134. By fixing longitudinal axis 153 as described, greater stability control during use of the exercise station 101 can be achieved, thereby allowing a user to more effectively isolate and develop particular muscles groups. In one embodiment, the upper rocker assembly 146 may rock 18 degrees in either direction relative to the lower rocker assembly 152 and about the fixed longitudinal axis 153. The two spaced apart brackets 157 of the lower rocker assembly 152 are connected to connection members 116 and 118 of base 120. In an exemplary embodiment, the upper rocker brackets 147 include pads 155 that may be used to limit the travel of upper rocker brackets by contacting the connection members 116 and 118 of base 120. The pads 155 may be adjusted to increase or decrease the range the upper rocker assembly 146 may rock relative to the lower rocker assembly 152. In one preferred embodiment, rocking of the upper rocker assembly 146 is limited to no more than approximately +/−45 degrees, and optimally, approximately +/−18 degrees or less (total range is 36 degrees or less) about the fixed longitudinal axis 153. The pads 155 may be made of rubber or other pliable, vibration dampening material.

Figure 4:
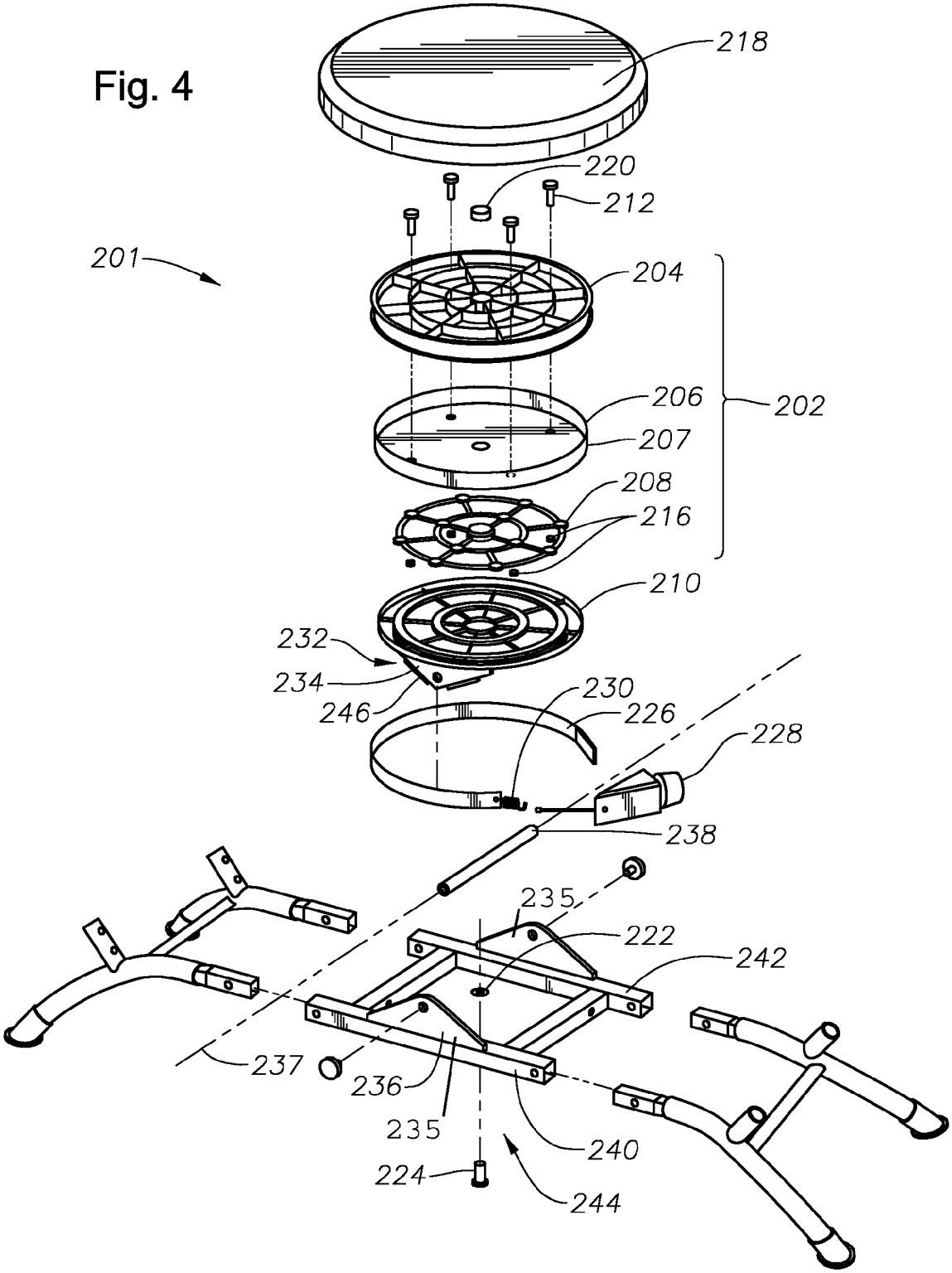
FIG. 4 illustrates a partially exploded view of one embodiment of an exercise machine.

FIG. 4 illustrates an exploded view of another embodiment of a seat assembly that includes a drum assembly 202. Drum assembly 202 includes a first drum support structure 204 to which a drum 206 is attached. Secured to drum 206 is a second drum support structure 208 which is generally rotatably engaged by a plate 210. Components 204, 206, 208, and 210 fit together via fasteners 212 and 216 so as to produce an exposed outer circular surface area 207 for drum 206. Seat 218 attaches to drum 206 via fasteners 220, 222, and 224. Although seat 218 is depicted here as a circular seat, seat 218 may be any geometric shape suitable for allowing a user to sit on exercise station 201, including, but not limited to, circular, square, rectangular, substantially triangular, a contour shape custom-fitted to a user, or any combination thereof.

Band 226 substantially encircles drum 206 to engage the outer circular surface area 207 and is disposed so as to provide resistance or friction to act as a brake against the rotation of drum 206 and correspondingly, as to the rotation of seat 218. Adjustable tensioner 228 in conjunction with spring 230 may be used to increase the tension exerted by band 226 upon drum 206. In this way, band 226 may be used to vary the intensity of a workout by increasing or decreasing the rotational resistance of seat 218. Band 226 may be fabricated out of any material suitable for providing resistance or friction to the rotation of drum 206, including, but not limited to, nylon, any of the fabrics known in the art, plastic, rubber, or any combination thereof. Alternatively, in certain embodiments, adjustable tensioner 228 incorporates a disc brake mechanism in lieu of band 226 for causing resistance or rotational friction to drum 206. Likewise, those skilled in the art will appreciate that adjustable tensioner 228 could have other arrangements so long as adjustable tensioner is capable of regulating rotation resistance of seat 218 relative to base assembly 210.

In this preferred embodiment, plate 210 includes an upper rocker assembly 232 mounted on the underside of plate 210. The upper rocker assembly 232 comprises spaced apart brackets 234 disposed for receipt of a rocker bolt 238. Rocker bolt 238 pivotally connects upper rocker assembly 232 with lower rocker assembly 236. Lower rocker assembly 236 comprises spaced apart brackets 235 disposed for receipt of rocker bolt 238. Brackets 235 of the lower rocker assembly are connected to connection members 240 and 242 of base 244. The upper rocker assembly 232 may then rotate, or rock, in either direction relative to the lower rocker assembly 236 around a fixed longitudinal axis 237 formed by the rocker bolt 238. The fixed longitudinal axis 237 is then in a fixed direction and always in between and parallel to the vertical plane formed by the two handles 134. In one embodiment, the upper rocker assembly 232 may rock 18 degrees in either direction relative to the lower rocker assembly 236 around the fixed longitudinal axis 237. The upper rocker assembly 232 includes pads 246 that may be used to limit the travel of upper rocker assembly by contacting the connection members 240 and 242 of base 244. The pads 246 may be adjusted to increase or decrease the range the upper rocker assembly 232 may rock relative to the lower rocker assembly 236. In one preferred embodiment, rocking of the upper rocker assembly 232 is limited to no more than approximately +/−45 degrees, and optimally, approximately +/−18 degrees or less (total range is 36 degrees or less) about the fixed longitudinal axis 237. The pads 246 may be made of rubber or other pliable, vibration dampening material.

Figure 5:
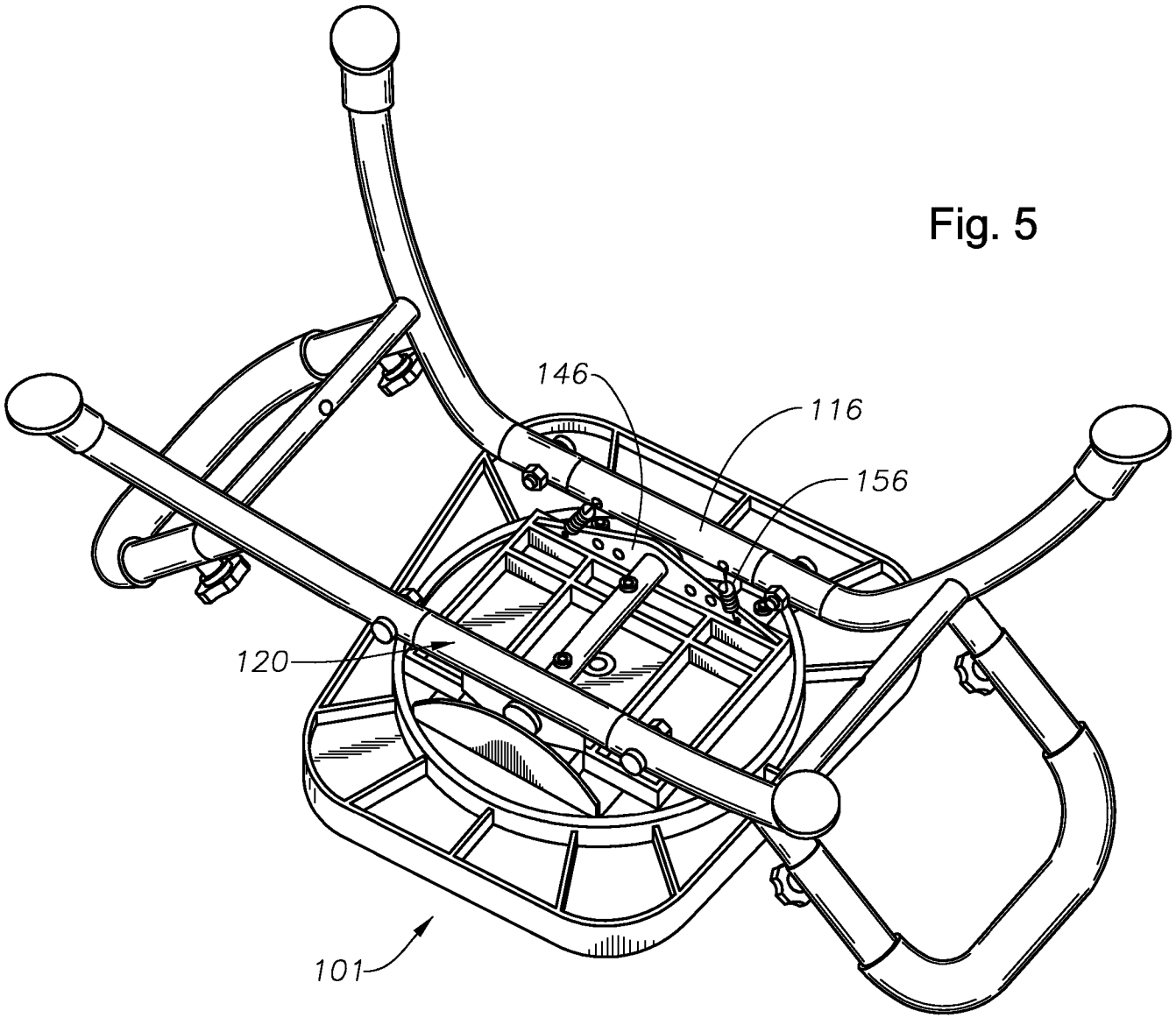
FIG. 5 illustrates a bottom perspective views of one embodiment of an exercise machine in which springs are installed for tensioning of the rocker plate.

FIG. 5 illustrates a bottom perspective view of one embodiment of exercise station 101 with springs 156 connected between the connection member 116 of base 120 and the upper rocker bracket 147 to add resistance to the rocking motion. Although not illustrated, springs 156 may also be connected between the upper rocker bracket 147 and connection member 118. In one embodiment, the springs 156 may have an adjustable tension in a manner well known in the art.

Figure 6:
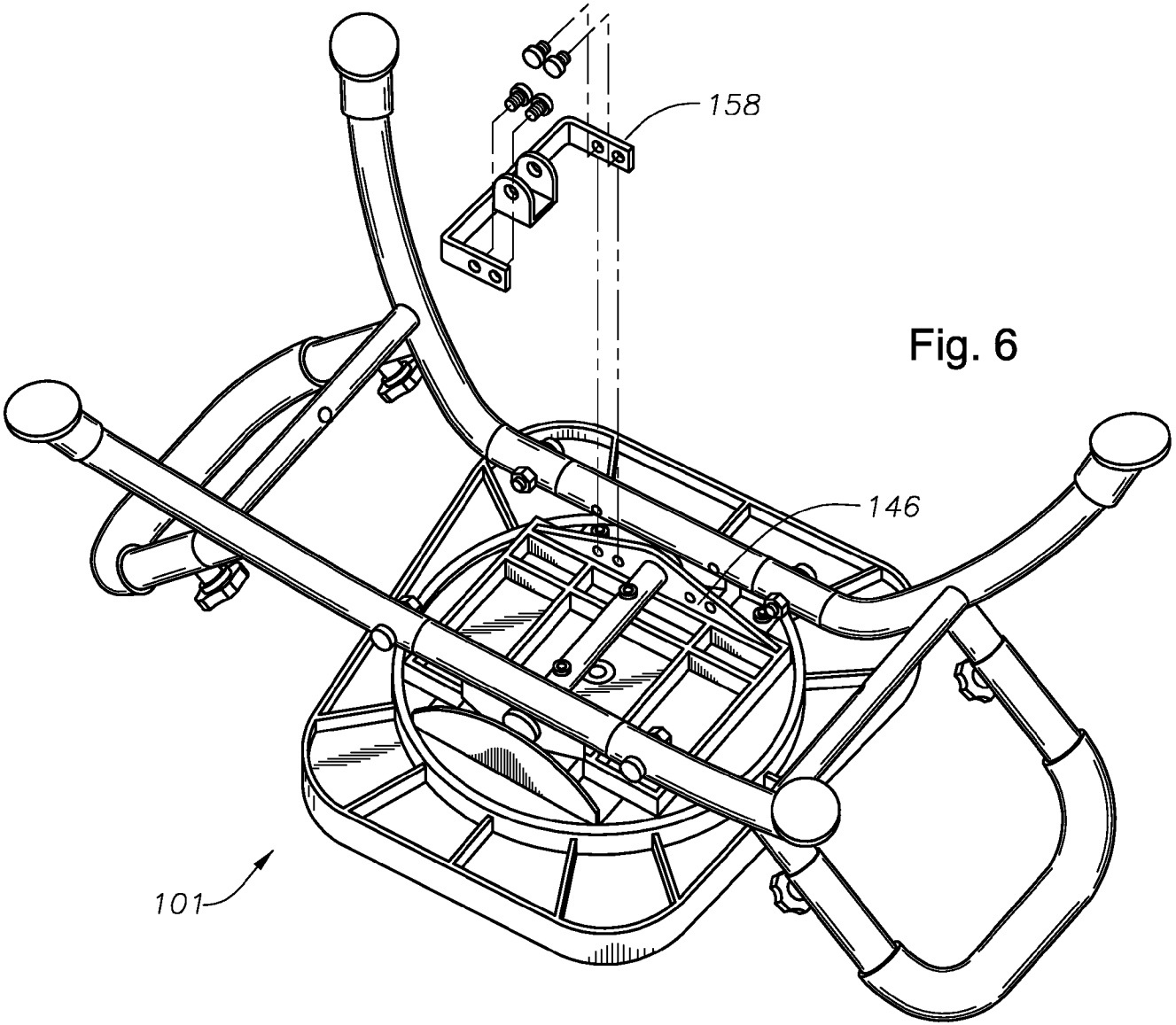
FIGS. 6 and 7 illustrate bottom perspective views of one embodiment of an exercise machine in which a piston is installed for tensioning of the rocker plate.
Figure 7:
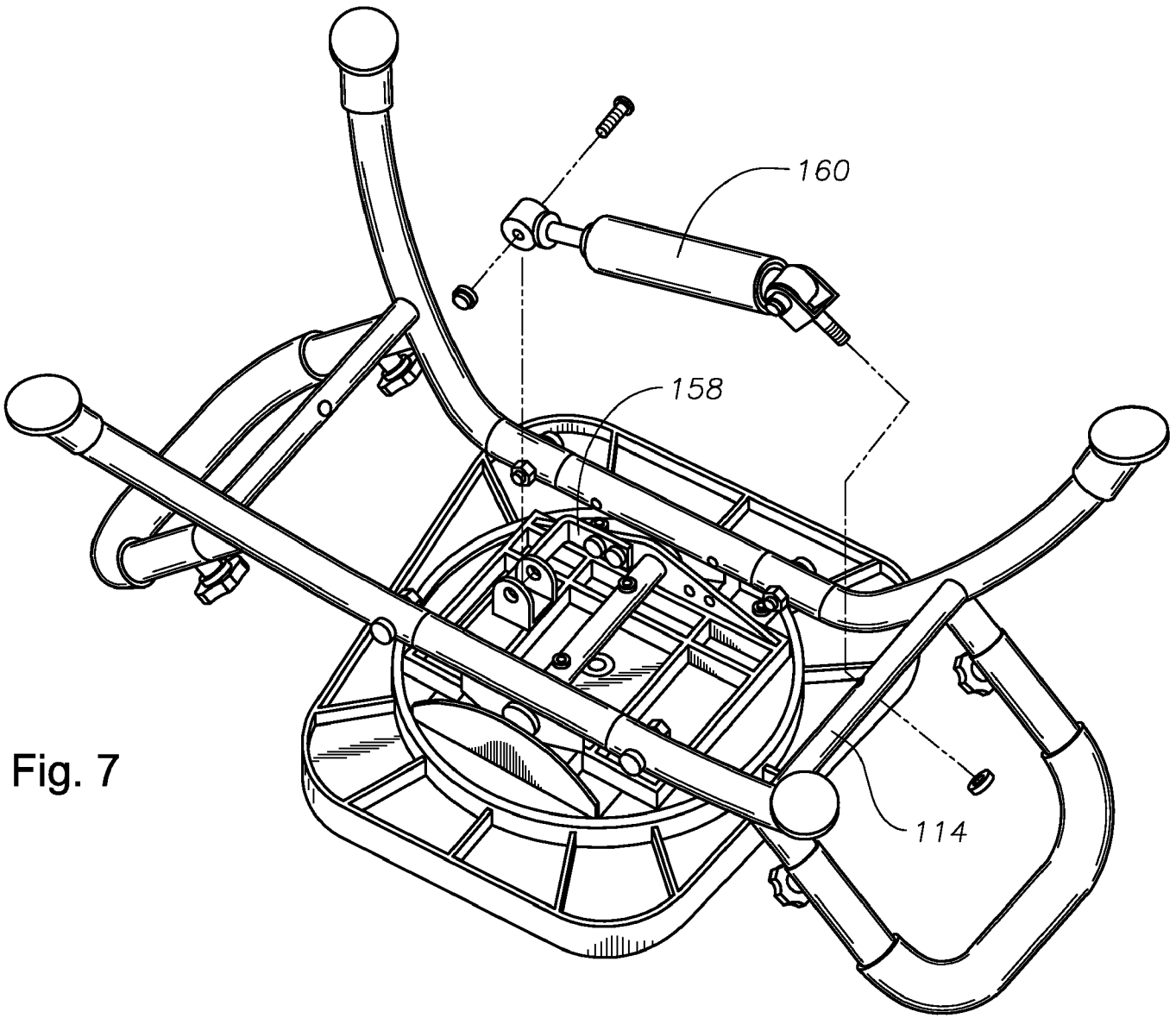

FIGS. 6 and 7 illustrate another embodiment of the exercise station 101 in which a piston support member 158 is connected to the upper rocker brackets 147. One end of piston 160 is then connected to the piston support member 158 and the other end of piston 160 is connected to the cross member 114. In one embodiment, the piston 160 has an adjustable resistance. In one embodiment, the piston 160 has an adjustable volume. The piston 160 may also be used to limit the rocking range of the upper rocker assembly 146.

A numerous variety of exercises may be used with exercise station 101 depending on the desired muscles targeted for each exercise and the intensity of exercise desired. For example, while sitting on exercise station 101, the user may rest their feet on the floor for a less intense workout or during a warm-up. Lifting one's legs during exercises while keeping the legs at approximately a 90 degree angle at the knees, adds further intensity to the user's effort while at the same time, targeting certain lower abdominal muscles. For an even more intense workout, the user may extend the legs outward to a 30 degree angle while rotating on the seat. Indeed, the user's legs may be extended completely or at any other angle as desired. Notably, the fixed longitudinal axis extends in a fixed direction so as to always be between and parallel to the vertical plane formed by the two handles. By fixing the longitudinal axis as described, greater stability control during use of the exercise station 101 can be achieved, thereby allowing a user to more effectively isolate and develop particular muscles groups. Exercise station 101 is adaptable to a multitude of other exercises as would be apparent to one of ordinary skill with the benefit of this disclosure.

The components of exercise station 101 may be constructed of any suitable material capable of withstanding the rigors imposed upon the device through normal exercise use, including, but not limited to, metal, the various alloys known in the art, plastic, or any combination thereof. In certain embodiments, sturdy lightweight materials are preferred to enhance the portability of exercise station 101. In certain embodiments, components of exercise station 101 are hollow to reduce the weight of the device, such as for example, the hollow tubular members of subframes 102 and 104. In other embodiments, various components of exercise station 101 may be weighted or include weighted plugs to give a more "substantial feel" to exercise station 101.

In some embodiments, exercise station 101 may be used as an underwater aerobic exercise device or for shallow pool physical therapy exercises. In these embodiments, various members of exercise station 101 may be weighted so as to cause exercise station 101 to securely engage the pool floor. Components of exercise station 101 may be modified so as to be water compatible, including, but not limited to, the use of coated or rust-free materials.

Base 120 may be easily and conveniently removed from subframes 102 and 104 of exercise station 101 by removal of fasteners 126 and 128, which allow for the separation of base 120 from subframes 102 and 104. In this way, exercise station 101 may be conveniently disassembled for easy storage and transport. Fasteners 126 and 128 may be attached subframes 102 and 104 via a loose cord or wire, such as a nylon cord, to prevent loss of fasteners 126 and 128. Additionally, base 120 may be used separately and apart from subframes 102 and 104 by placing base 120 directly on the ground. This configuration allows the user to perform a variety of exercises using only base 120.

Examples of exercises that may be performed with base 120, but without subframe 102 and 104, include performing the plank position with the user's elbows positioned on the seat or performing push-ups with the user's hands positioned on the seat. Additionally, a user may intensely target the transverse abdominal muscles with pelvic crunches with the pelvis situated on seat 140 with the user in the prone position. By rotating the pelvis on seat 140 so as to swing the legs back and forth, the user can work the transverse abdominal muscles. Another exercise, referred to herein as stabilized transverse abdominal crunches, places the user in a prone position with the feet together and spacing one's forearms at shoulder width apart on seat 140. The upper body is then rotated with shoulder and abdominal powered rotational movements or strides. Alternatively, a user may lay down on base 120, engaging the shoulder blades with seat 140. In this position, facing up, the user can rotate using a side-to-side motion to target the oblique muscles.

Exercises performed with exercise station 101 may include traditional push-ups and tricep dips using support handles 134. Other examples include knee side crunches wherein the user sits on their knees upon cushioned seat 140 and using support handles 134 rotates side to side so as to work the lower oblique muscles. Other exercises include leg lifts, leg extensions, or knee lifts while the user is sitting on rotatable seat 140 and simultaneously rotating in a swinging motion from side-to-side. The user may rotate in short side-to-side motions or the user may use a wider range of motion or strides. For additional variety and simultaneous upper body strengthening or cardio activity, the user may combine the aforementioned exercises with upper body punches side-to-side, which may further be combined with counter rotational movements of the core of the body using rotatable seat 140.

Exercise station 101 may include other features such as a weight scale for measuring the weight of the user, incorporated, for example, into base 120. In certain embodiments, a body fat analyzer may be incorporated into seat 140 for analyzing the body fat percentage of the user. In other embodiments, heart rate sensors may be incorporated in support handles 134 for measuring the heart rate of the user. Any number of other items useful to exercise enthusiasts known in the art may be incorporated in exercise station 101.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. An exercise machine comprising:

a base having at least three spaced apart legs and two spaced apart handles attached to said base, said base further comprising a frame to which the legs attach, each leg having a proximal and distal end;

said frame characterized by a substantially horizontal longitudinal axis of rotation, said longitudinal axis of rotation passing between said handles and substantially parallel to said handles, wherein the proximal end of the legs attach to the base;

a rocker assembly, said rocker assembly comprising a rocker fastener and first and second sets of spaced apart brackets, each bracket having an aperture there through, said first set of brackets secured to said base so that said apertures of said first spaced apart brackets are coaxial with the longitudinal axis of rotation, said second set of brackets disposed adjacent said first set of brackets so that the apertures of the second set of brackets are aligned with the apertures of the first set of brackets, wherein said rocker fastener extends through the aligned apertures and along said longitudinal axis of rotation so that the second set of bracket rotates approximately +/−18 degrees or less about the axis of rotation in a side-to-side motion relative to the base frame and between the handles;

wherein said longitudinal axis of rotation is fixed in the direction defined by the first and second sets of spaced apart brackets and wherein the second set of spaced apart brackets rotates only about said longitudinal axis of rotation;

a seat having a top side with a generally planar upper surface and underside;

a rotation assembly coupled to and disposed between the underside of the seat assembly and the second set of brackets, the rotation assembly configured to enable rotation of the seat relative to the second set of brackets, wherein the axis of rotation of the seat is oriented generally perpendicular to the upper surface of the seat and perpendicularly intersects the longitudinal axis of rotation;

an adjustable stop to limit rotation of the seat relative to the second set of brackets, wherein the adjustable stop limits rotation of the seat around the axis of rotation to 360 degrees to some lesser amount;

at least one tensioning mechanism, wherein said tensioning mechanism provides tension against side-to-side motion of said second set of bracket relative to said base;

wherein the tensioning mechanism comprises one or more springs; and wherein said spring has a first end and a second end, with one end of the spring attached to the base and the other end of the spring attached to the second set of brackets.

2. The exercise machine of claim 1, wherein said rotation assembly further comprises a circular drum having an outer circumferential surface, said drum attached to the underside of said seat, said exercise machine further comprising a brake wherein the brake comprises a band disposed at least partially around the outer circumferential surface of said circular drum to frictionally engage the drum and an adjustable tensioner attached to the band for adjusting friction between the band and the first circular drum.

3. An exercise machine comprising:

a base having at least three spaced apart legs and two spaced apart handles attached to said base, said base further comprising a frame to which the legs attach, each leg having a proximal and distal end;

said frame characterized by a substantially horizontal longitudinal axis of rotation, said longitudinal axis of rotation passing between said handles and substantially parallel to said handles, wherein the proximal end of the legs attach to the base;

a rocker assembly, said rocker assembly comprising a rocker fastener and first and second sets of spaced apart brackets, each bracket having an aperture there through, said first set of brackets secured to said base so that said apertures of said first spaced apart brackets are coaxial with the longitudinal axis of rotation, said second set of brackets disposed adjacent said first set of brackets so that the apertures of the second set of brackets are aligned with the apertures of the first set of brackets, wherein said rocker fastener extends through the aligned apertures and along said longitudinal axis of rotation so that the second set of bracket rotates approximately +/−18 degrees or less about the axis of rotation in a side-to-side motion relative to the base frame and between the handles;

wherein said longitudinal axis of rotation is fixed in the direction defined by the first and second sets of spaced apart brackets and wherein the second set of spaced apart brackets rotates only about said longitudinal axis of rotation;

a seat having a top side with a generally planar upper surface and underside;

a rotation assembly coupled to and disposed between the underside of the seat assembly and the second set of brackets, the rotation assembly configured to enable rotation of the seat relative to the second set of brackets, wherein the axis of rotation of the seat is oriented generally perpendicular to the upper surface of the seat and perpendicularly intersects the longitudinal axis of rotation;

a stop to limit rotation of the seat relative to the second set of brackets, wherein the stop limits rotation of the seat around the axis of rotation to approximately +/−20 degrees or less;

at least one tensioning mechanism, wherein said tensioning mechanism provides tension against side-to-side motion of said second set of bracket relative to said base;

wherein the tensioning mechanism comprises one or more pistons; and wherein said piston has a first end and a second end, with one end of the piston attached to the base and the other end of the piston attached to the second set of bracket.

4. The exercise machine of claim 3, wherein said rotation assembly further comprises a circular drum having an outer circumferential surface, said drum attached to the underside of said seat, said exercise machine further comprising a brake wherein the brake comprises a band disposed at least partially around the outer circumferential surface of said circular drum to frictionally engage the drum and an adjustable tensioner attached to the band for adjusting friction between the band and the first circular drum.

5. The exercise machine of claim 3, wherein said piston has an adjustable volume.

6. An exercise machine comprising:

a base having at least three spaced apart legs and two spaced apart handles attached to said base, said base further comprising a frame to which the legs attach, each leg having a proximal and distal end;

said frame characterized by a substantially horizontal longitudinal axis of rotation, said longitudinal axis of rotation passing between said handles and substantially parallel to said handles, wherein the proximal end of the legs attach to the base;

a rocker assembly, said rocker assembly comprising a rocker fastener and first and second sets of spaced apart brackets, each bracket having an aperture there through, said first set of brackets secured to said base so that said apertures of said first spaced apart brackets are coaxial with the longitudinal axis of rotation, said second set of brackets disposed adjacent said first set of brackets so that the apertures of the second set of brackets are aligned with the apertures of the first set of brackets, wherein said rocker fastener extends through the aligned apertures and along said longitudinal axis of rotation so that the second set of bracket rotates approximately +/−18 degrees or less about the axis of rotation in a side-to-side motion relative to the base frame and between the handles;

wherein said longitudinal axis of rotation is fixed in the direction defined by the first and second sets of spaced apart brackets and wherein the second set of spaced apart brackets rotates only about said longitudinal axis of rotation;

a seat having a top side with a generally planar upper surface and underside;

a rotation assembly coupled to and disposed between the underside of the seat assembly and the second set of brackets, the rotation assembly configured to enable rotation of the seat relative to the second set of brackets, wherein the axis of rotation of the seat is oriented generally perpendicular to the upper surface of the seat and perpendicularly intersects the longitudinal axis of rotation;

an adjustable stop to limit rotation of the seat relative to the second set of brackets, wherein the adjustable stop limits rotation of the seat around the axis of rotation to 360 degrees to some lesser amount;

at least one tensioning mechanism, wherein said tensioning mechanism provides tension against side-to-side motion of said second set of bracket relative to said base;

wherein the tensioning mechanism comprises one or more pistons; and wherein said piston has a first end and a second end, with one end of the piston attached to the base and the other end of the piston attached to the second set of brackets.

7. The exercise machine of claim 6, wherein said rotation assembly further comprises a circular drum having an outer circumferential surface, said drum attached to the underside of said seat, said exercise machine further comprising a brake wherein the brake comprises a band disposed at least partially around the outer circumferential surface of said circular drum to frictionally engage the drum and an adjustable tensioner attached to the band for adjusting friction between the band and the first circular drum.

8. The exercise machine of claim 6, wherein said piston has an adjustable volume.

* * * * *